United States Patent [19]

Schuierer

[11] 4,104,753

[45] Aug. 8, 1978

[54] PROCESSES AND APPARATUS FOR THE BATCH WET TREATMENT OF TEXTILE MATERIAL

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 795,512

[22] Filed: May 10, 1977

[30] Foreign Application Priority Data

May 25, 1976 [DE] Fed. Rep. of Germany ..... 2623315

[51] Int. Cl.[2] ..... D06B 21/02

[52] U.S. Cl. ..... 8/152; 68/20; 68/62; 68/177

[58] Field of Search ..... 8/152; 68/20, 62, 176, 68/177, 178

[56] References Cited

U.S. PATENT DOCUMENTS

| | | | |
|---|---|---|---|
| 3,659,438 | 5/1972 | Chiba et al. | 68/177 |
| 3,681,946 | 8/1972 | Fleissner | 68/177 X |
| 3,894,411 | 7/1975 | Stanway | 68/20 |
| 3,949,575 | 4/1976 | Turner et al. | 68/20 X |

*Primary Examiner*—Philip R. Coe

*Attorney, Agent, or Firm*—Learman & McCulloch

[57] ABSTRACT

Textile material to be dyed is circulated through a dyeing machine containing a hot liquid dye bath in such manner that the material repeatedly is immersed in and removed from the dye liquor. Following removal of the material from the dye liquor it is subjected to treatment by air to remove surplus liquid from the material prior to the return of the material to the dye liquor. Following its final removal from the dye liquor the material is cooled by being sprinkled with water at a temperature lower than that of the dye liquor.

12 Claims, 4 Drawing Figures

Figure 1:
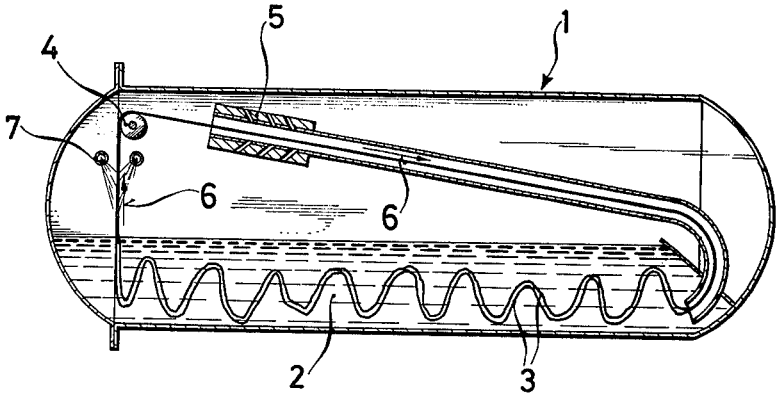

FIG. 3
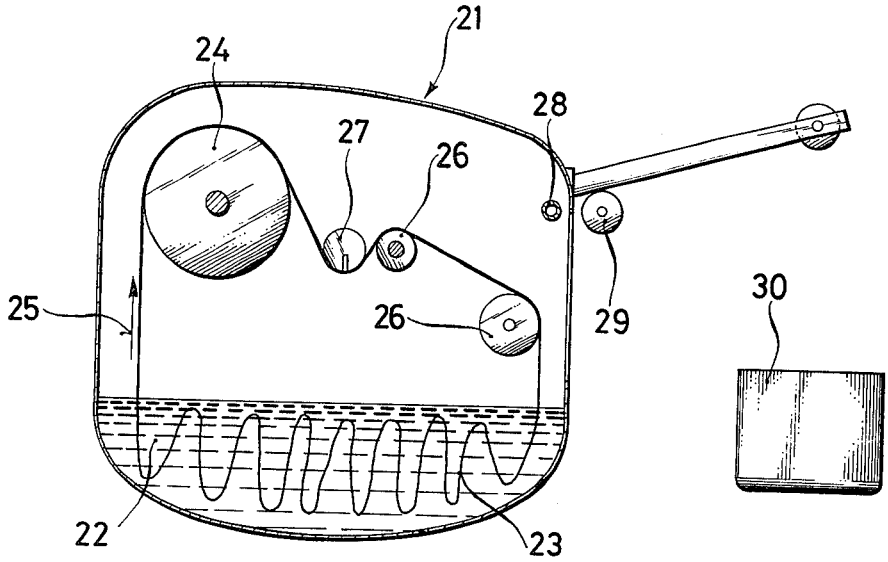
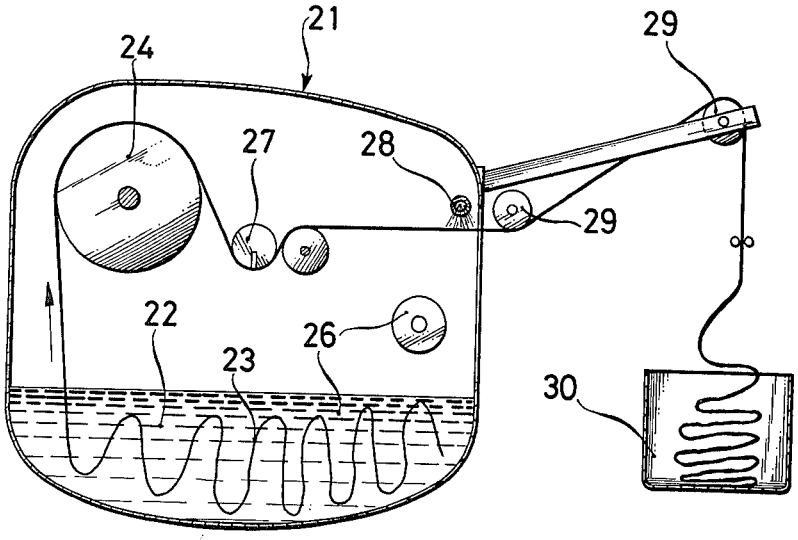
FIG. 4

PROCESSES AND APPARATUS FOR THE BATCH WET TREATMENT OF TEXTILE MATERIAL

This invention relates to a process for the batch wet treatment, more especially for dyeing, textile material in a machine in which the textile material circulates and, during its circulation, is repeatedly removed from and reintroduced elsewhere into the dye bath.

The invention also relates to an apparatus for carrying out this process, more especially a dyeing machine.

The invention is described in the following with reference t dyeing as its principal application. However, it may also be used with advantage for other batch wet treatments of textile material, for example for desizing, washing and bleaching.

In the conventional process of batch dyeing textile material, the textile material is passed through the dye bath in strand form or at full width, its circulating movement generally being produced either by a winch or by a nozzle system. During each circuit, the textile material is removed once from the dye bath and dips back elsewhere into the dye bath. It has recently been recognized that the greater the number of circuits and hence the number of "contacts" between liquor and textile, the better is the mass exchange process between dye liquor and textile material over a certain period of time. Accordingly, efforts to improve and intensify the batch dyeing process have hitherto been aimed at shortening the strand of textile material in the machine and increasing the speed of circulation. However, it is obvious that improvements in this direction are only possible within certain limits.

The object of the present invention is to provide a process for the batch wet treatment, particularly dyeing, of textile material, which enables the mass exchange between liquor and textile material to be considerably intensified with particularly simple means and leading to a considerable reduction in the treatment time whilst at the same time saving energy.

According to the invention, this object is achieved by virtue of the fact that the textile material removed from the dye bath is freed from the surplus dye liquor adhering to it by the action of air before being reintroduced into the dye bath.

In the conventional process a large amount of the surplus dye liquor entrained during removal of the textile material from the dye bath remains in and on the textile material until the textile material dips back into the dye bath. The present invention makes use of the realization that a considerable improvement in the mass exchange process between the liquor and the textile material is obtained when at least a considerable part of the surplus dye liquor entrained by the textile material during its removal from the dye bath is removed from the textile material before the textile material dips back elsewhere into the dye bath, because this ensures that, when the textile material dips back into the dye bath, new or fresh liquor comes into contact with the individual zones of the textile material. In this way, the mass exchange process is considerably improved and, hence, the treatment time is considerably shortened.

According to the invention, the adhering surplus dye liquor is removed by the action of air which has the advantage over other possible measures (for example by means of squeezing rolls) that the treatment of the textile material is particularly gentle and readily adaptable within wide limits, and in addition can be achieved with particularly simple means and a minimal energy requirement.

This treatment with air may be carried out either with a jet of air directed onto the textile material or suction effect on the textile material.

In one practical embodiment of the process according to the invention, the textile material is freed from the adhering surplus dye liquor by the action of air on completion of the wet treatment and before removal from the machine and is then cooled by sprinkling with cold water.

In this way, the textile material, for example a tufted carpet, can be removed from the boiling liquor at full width, largely freed from the hot liquor at full width, i.e., in non-folded form, and then subjected to shock-like cooling by sprinkling with cold water. In contrast to the conventional process, in which cooling had to be carried out in the dyeing machine, the formation of cross-breaks in the textile material is avoided in the process according to the invention. The textile material cooled by sprinkling with cold water can be taken off without difficulty, i.e., without any danger of creasing, outside the machine.

It is clear that the removal of the surplus dye liquor adhering to the textile material in accordance with the invention is an essential requirement for the effectiveness of the subsequent cold-water treatment. Another important advantage of this procedure arises out of the fact that the liquor does not have to be cooled in order to be able to remove the textile material from the machine. In this way, the liquor can be re-used in hot form or energy can be suitably recovered from the hot liquor.

Figure 2:
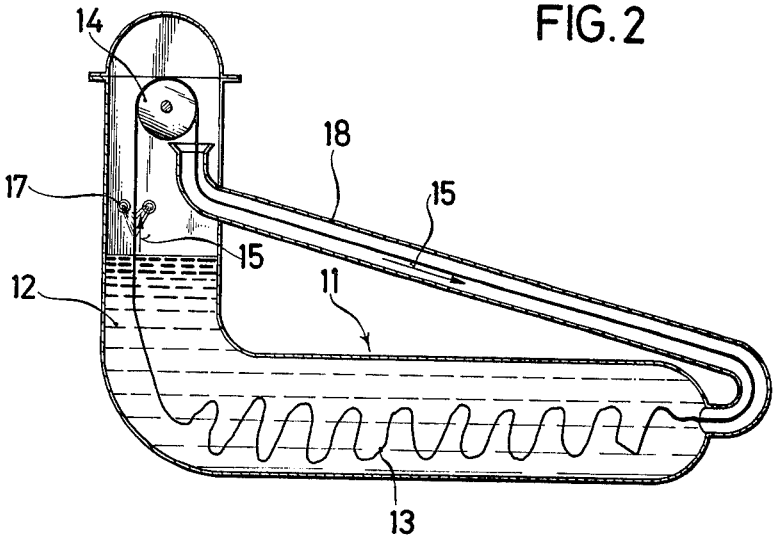

Illustrative embodiments of the invention are shown in the accompanying drawings, wherein:

FIGS. 1 and 2 diagrammatically illustrate two embodiments of dyeing machines for carrying out the process according to the invention; and FIGS. 3 and 4 diagrammatically illustrate another embodiment in operation (FIG. 3) and during removal of the textile material (FIG. 4).

The dyeing machine 1 illustrated in FIG. 1 contains a liquor bath 2 forming a residence zone for an endless loop of the textile material 3 which is in the form of individual strands guided adjacent one another.

The individual strands of the textile material 3 travel over a guide roller 4 outside the liquor bath 2 and through a nozzle system 5 (only diagrammatically illustrated) fed with liquor in a known manner. The direction of circulation of the textile material is indicated by the arrows 6.

A nozzle system 7 is provided between the point at which the textile material 3 emerges from the liquor bath 2 and the guide roller 4. This nozzle system 7, which is supplied with compressed air by fans or a high pressure blower (not shown), is used to remove the adhering surplus liquor from the textile material 3.

In cases where the textile material is in the form of a plurality of adjacent strands, as assumed in the case of FIG. 1, the nozzle system 7 may be formed for example by a number of annular nozzles corresponding to the number of strands of textile material, the individual strands of textile material being guided through separate annular nozzles. Accordingly, these annular nozzles lie one behind the other perpendicularly of the plane of FIG. 1.

Annular nozzles such as these may be in the form of, for example, round nozzles or rectangular nozzles assembled from segments.

For the treatment of textile material at full width, for example carpeting, elongated nozzle tubes of known constructions and arranged in pairs, through which the textile material passes, are best used for the nozzle system 7.

FIG. 2 shows an embodiment in which a liquor bath 12 is present in a dyeing machine 11 as a residence zone for the loop of textile material 13. A winch 14 is responsible for the circulation of the textile material 13 in the direction of the arrows 15.

The textile material removed from the liquor bath 12 is freed from the adhering surplus dye liquor to a large extent by a nozzle system 17 fed with compressed air from a source thereof (not shown). The textile material running off the winch 14 enters a liquor-filled tube 18 and hence comes back into contact with fresh liquor during its actual return to the liquor bath 12.

FIGS. 3 and 4 show an embodiment of a dyeing machine 21 with a liquor bath 22 for an endless loop of textile material 23 which is kept in circulation (arrow 25) by a winch 24.

A nozzle system 27 (either pressure or suction) is provided between the winch 24 and two guide rollers 26 for removing the surplus liquor adhering to the textile material. If the textile material 23 is in the form of, for example, a carpet guided at full width in the dyeing machine 21, the nozzle system 27 best consists of a nozzle tube (extending perpendicularly of the plane of FIG. 3).

The dyeing machine 21 also contains a cold water sprinkler 28 the function of which is apparent from FIG. 4.

Once the wet treatment is over and if the textile material 23, for example a carpet, is to be removed from the dyeing machine 21, the endless loop of textile material is opened and the textile material is removed from the machine in the manner illustrated in FIG. 4 (guide rollers 29 and take-off unit 30). To facilitate this removal of the textile material 23 from hot liquor and immediate folding outside the dyeing machine 21, cold water is sprinkled onto the textile material 23 by the sprinkler 28 after the adhering surplus liquor has been removed from the textile material 23 by the nozzle system 27. Extensive shock-like cooling of the textile material 23 (for example to below 50° C) is obtained in this way, so that the textile material can be taken off smoothly without creasing.

The following data further illustrate the advance obtained by the invention:

EXAMPLE 1

150 kg. of polyester/cotton material was dyed in a jet machine (similar to FIG. 1) with standard assortments of dispersion and reactive dyes. If the air-operated blowing nozzle system is only used during rinsing of the material, the total rinsing time is shortened by 40% (compared with the procedure operating without the blowing nozzle system). A further significant reduction in the total treatment time is obtained if the blowing nozzle system is also used during the actual dyeing process.

EXAMPLE 2

Printed material was washed out in a pressureless winch vat, the material (polyester articles and polyester blends) passing contnuously through the vat at a rate of 50 meters per minutes. If the vat is operated without the blowing nozzle system according to the invention, 50 treatment stages (circuits) are necessary for obtaining complete cleanness at critical pressures. By contrast, using the blowing nozzle system according to the invention, the number of treatment stages is reduced by half.

EXAMPLE 3

Polyester jersey was dyed under pressure in a dyeing machine of the type illustrated in FIG. 2. Throughout the entire heating and temperature-holding period, the strand of material was freed from the surplus liquid by the blowing nozzle system so that it was wetted much more intensively with the fresh liquor. The dyeing time could be reduced by 20 to 30% in relation to a procedure operating without the blowing nozzle system.

EXAMPLE 4

The compressed-air-operated nozzle system according to the invention was installed in a carpet winch vat (of the type illustrated in FIGS. 3 and 4) and used during dyeing and rinsing. The improvement in mass exchange obtained in this way reduced the treatment time by 20 to 30%.

I claim:

1. A process for the wet treatment of textile material comprising introducing said material to a treatment chamber containing a bath of hot treatment liquid; repeatedly immersing and removing said material in and from said liquid; subjecting said material to treatment by air following each removal of said material from said liquid to remove surplus liquid from said material; moving said material out of said chamber following a final air treatment; and spraying onto said material a fluid having a temperature lower than that of said liquid to cool said material prior to passage of said material out of said chamber.

2. A process according to claim 1 wherein said air treatment comprises blowing air into said material.

3. A process according to claim 1 wherein said air treatment comprises subjecting said material to suction.

4. A process according to claim 1 wherein said material is in the form of an endless loop.

5. A process according to claim 4 wherein said material comprises a plurality of side-by-side strands.

6. A process according to claim 4 wherein said material comprises a web.

7. A process according to claim 1 wherein said material is in the form of an endless loop, and including opening said loop to form an elongate webe prior to the spraying of said fluid onto said material.

8. A process according to claim 1 wherein the fluid sprayed onto said material is water.

9. Apparatus for the wet treatment of textile material comprising means forming a chamber for containing a bath of hot treatment liquid; means for moving said material through said container to repeatedly immerse and remove said material in and from said liquid; air means operable to remove surplus liquid from said material; means mounting said air means in a position to subject said material to the operation of said air means each time said material is removed from said liquid; and cooling means withn said chamber downstream from said air means for spraying said material with fluid having a temperature lower than that of said liquid to cool said material following its final removal from said liquid.

10. Apparatus according to claim 9 wherein said air means directs air under pressure through said material.

11. Apparatus according to claim 9 wherein said air means subjects said material to suction.

12. Apparatus according to claim 9 wherein said cooling means comprises nozzle means for spraying water on said material.

* * * * *